US008471788B2

(12) United States Patent
Cha et al.

(10) Patent No.: US 8,471,788 B2
(45) Date of Patent: Jun. 25, 2013

(54) ORGANIC LIGHT EMITTING DIODE DRIVER

(75) Inventors: Sang Hyun Cha, Seoul (KR); Yeun Joong Lee, Seoul (KR); Gyu Hyeong Cho, Daejeon (KR); Jin Yong Jeon, Daegu (KR); Jun Hyeok Yang, Daegu (KR); Hyun Sik Kim, Jeollabuk-do (KR); Jae Shin Lee, Gyunggi-do (KR)

(73) Assignee: Samsung Electro-Mechanics Co., Ltd., Suwon, Gyunggi-Do (KR)

( * ) Notice: Subject to any disclaimer, the term of this patent is extended or adjusted under 35 U.S.C. 154(b) by 303 days.

(21) Appl. No.: 13/036,363

(22) Filed: Feb. 28, 2011

(65) Prior Publication Data

US 2012/0044269 A1 Feb. 23, 2012

(30) Foreign Application Priority Data

Aug. 20, 2010 (KR) ..... 10-2010-0080663

(51) Int. Cl.
*G09G 3/30* (2006.01)

(52) U.S. Cl.
USPC ..... 345/76; 345/77

(58) Field of Classification Search
USPC ..... 345/76, 77, 82, 83, 92, 690, 89
See application file for complete search history.

(56) References Cited

U.S. PATENT DOCUMENTS

| | | | | |
|---|---|---|---|---|
| 2002/0047550 | A1 | 4/2002 | Tanada | |
| 2005/0041003 | A1 | 2/2005 | Yamada | |
| 2009/0033602 | A1 * | 2/2009 | Alexander et al. | 345/77 |
| 2009/0195483 | A1 | 8/2009 | Naugler, Jr. et al. | |
| 2010/0141667 | A1 * | 6/2010 | Chiou et al. | 345/690 |

FOREIGN PATENT DOCUMENTS

| | | | |
|---|---|---|---|
| JP | 11-015437 | A | 1/1999 |
| JP | 2002-169511 | A | 6/2002 |
| JP | 2004-029714 | A | 1/2004 |
| JP | 2006-178030 | A | 7/2006 |
| JP | 2007-171507 | A | 7/2007 |
| JP | 2012-037862 | A | 2/2012 |
| KR | 10-2009-0020190 | A | 2/2009 |

OTHER PUBLICATIONS

Japanese Office Action, and English translation thereof, issued in Japanese Patent Application No. 2011-028874 dated Sep. 4, 2012.

* cited by examiner

*Primary Examiner* — Kevin M Nguyen
(74) *Attorney, Agent, or Firm* — McDermott Will & Emery LLP

(57) ABSTRACT

There is provided an organic light emitting diode driver capable of compensating for pixel deterioration in real time during the driving of pixels by selectively compensating pixels, requiring compensation, for the deterioration thereof, and precisely setting calibration data by removing an IR drop across a transistor, employed as a switch in the pixels, by calculating a difference between at least two representative values of different gray scale ranges among predetermined gray scale ranges.

9 Claims, 4 Drawing Sheets

ORGANIC LIGHT EMITTING DIODE DRIVER

CROSS-REFERENCE TO RELATED APPLICATIONS

This application claims the priority of Korean Patent Application No. 10-2010-0080663 filed on Aug. 20, 2010, in the Korean Intellectual Property Office, the disclosure of which is incorporated herein by reference.

BACKGROUND OF THE INVENTION

1. Field of the Invention

The present invention relates to an organic light emitting diode driver, and more particularly, to an organic light emitting diode driver capable of compensating for pixel deterioration in real time during the driving of pixels by selectively compensating pixels, requiring compensation, for the deterioration thereof, and precisely setting calibration data by removing an IR (current/resistance) drop across a transistor, employed as a switch in the pixels, by calculating a difference between at least two representative values of different gray scale ranges among predetermined gray scale ranges.

2. Description of the Related Art

In recent years, in general display devices such as a cathode ray tube (CRT) and a liquid crystal display (LCD), with the increased demand for display devices achieving a reduction in volume while having a large size, a great deal of attention has been drawn to display devices employing an organic light emitting diode (OLED) having a response rate significantly higher than that of an LCD and reducing the thickness and weight thereof by approximately two-thirds as compared with those of the LCD.

This OLED is divided into a passive matrix organic light emitting diode (PMOLED) and an active matrix organic light emitting diode (AMOLED) according to a driving method. In particular, an AMOLED capable of individually controlling pixels, which are the smallest elements of an image processed in a display system, is commonly used.

Such an AMOLED is superior in terms of image quality, thickness, weight, brightness, power consumption, and the like, as compared with existing LCDs.

However, this AMOLED display may suffer from deterioration, deterioration being defined as the generation of an image having gradually lower luminance in response to the same data signal as a certain period of time elapses, and this may result in a failure to display an image having uniform luminance.

SUMMARY OF THE INVENTION

An aspect of the present invention provides an organic light emitting diode driver capable of compensating for pixel deterioration in real time during the driving of pixels by selectively compensating pixels, requiring compensation, for the deterioration thereof, and precisely setting calibration data by removing an IR (current/resistance) drop across a transistor, employed as a switch in the pixels, by calculating a difference between at least two representative values of different gray scale ranges among predetermined gray scale ranges.

According to an aspect of the present invention, there is provided an organic light emitting diode driver including: a converting unit having predetermined gray scale ranges and converting input data into compensation data set as a representative value of a gray scale range, to which a gray scale level of the input data belongs, in order to selectively compensate for pixel deterioration depending on whether the input data has been calibrated or not; a driving unit driving pixels of a pixel unit based on the compensation data from the converting unit; and a compensating unit providing the converting unit with a deterioration compensation signal based on a difference between at least two level signals, each containing the representative value from the converting unit and deterioration information obtained from a pixel driven by the driving unit.

The converting unit may store calibration data included in the deterioration compensation signal from the compensating unit and converts input data for a target pixel to be non-calibrated into calibration data corresponding thereto.

The converting unit may include a compensation determining part determining whether the input data has been compensated for or not, depending on whether calibration data corresponding to a target pixel to be driven by the input data is present or not; a calibration data storing memory providing the calibration data corresponding to the input data based on a result of determination of the compensation determining part; and a compensation data generating part providing the compensation data and compensation level information corresponding to the input data based on a result of determination of the compensation determining part.

The compensation data generating part may have a plurality of predetermined gray scale ranges, provide the compensation data as the representative value of the gray scale range, to which the gray scale level of the input data belongs, and transmit the compensation level information including the representative value to the compensating unit.

The compensating unit may include a compensation level selecting part selecting a memory based on the compensation level information from the converting unit and the deterioration information of the driven pixel; a memory part including a plurality of memories corresponding to the number of the gray scale ranges; a previous data storing memory storing initial luminance data of the pixel to be compensated or luminance data obtained by a previous compensation; a deterioration calculator calculating a degree of deterioration in the pixel by comparing a difference between one level signal, containing compensation level information and deterioration information corresponding thereto, and another level signal, containing compensation level information and deterioration information corresponding thereto, the level signals being stored in the memory part, with the luminance data from the previous data storing memory; and a calibration data calculator calculating calibration data adjusting a luminance of the pixel according to the degree of deterioration calculated by the deterioration calculator. The compensating unit may include a compensation level selecting part selecting a memory based on the compensation level information from the converting unit and the deterioration information of the driven pixel; a memory part including a plurality of memories corresponding to the number of the gray scale ranges; a previous data storing memory storing initial luminance data and use time of the pixel to be compensated or luminance data and use time thereof obtained by a previous compensation; a deterioration calculator calculating a degree of deterioration in the pixel by comparing a difference between one level signal, containing compensation level information and deterioration information corresponding thereto, and another level signal, containing compensation level information and deterioration information corresponding thereto, the level signals being stored in the memory part, with the luminance data and the use time of the pixel from the previous data storing memory; and a calibration data calculator calculating calibration data adjusting a luminance of the pixel according to the degree of deterioration calculated by the deterioration calculator.

The calibration data calculator may calculate the calibration data adjusting the luminance of the pixel to have a luminance equal to an average luminance of all of the pixels.

The organic light emitting diode driver may further include an analog-to-digital converter (ADC) converting the deterioration information obtained from the driven pixel of the pixel unit into a digital deterioration sensing signal and transmitting the digital deterioration sensing signal to the compensating unit.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE PREFERRED EMBODIMENT

Exemplary embodiments of the present invention will now be described in detail with reference to the accompanying drawings.

Figure 1:
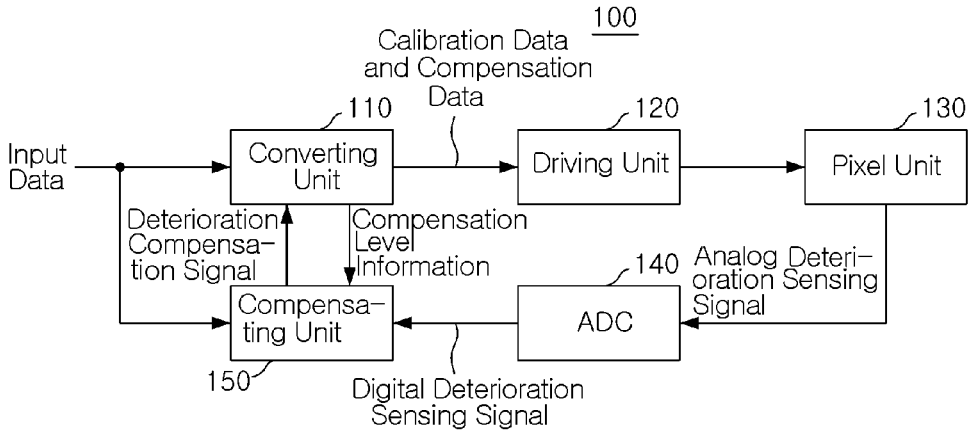
FIG. 1 is a schematic view illustrating the configuration of an organic light emitting diode driver according to an exemplary embodiment of the present invention.

FIG. 1 is a schematic view illustrating the configuration of an organic light emitting diode driver according to an exemplary embodiment of the present invention.

With reference to FIG. 1, an organic light emitting diode driver 100 according to an exemplary embodiment of the invention may include a converting unit 110, a driving unit 120, a pixel unit 130, an analog-to-digital converter (ADC) 140, and a compensating unit 150.

The converting unit 110 may receive input data used to drive a pixel. The input data may include a gray scale in order to drive a pixel corresponding thereto. Meanwhile, the converting unit 110 may convert the input data into calibration data, in which deterioration has been compensated for, or compensation data, which is used to compensate for deterioration.

Figure 2:
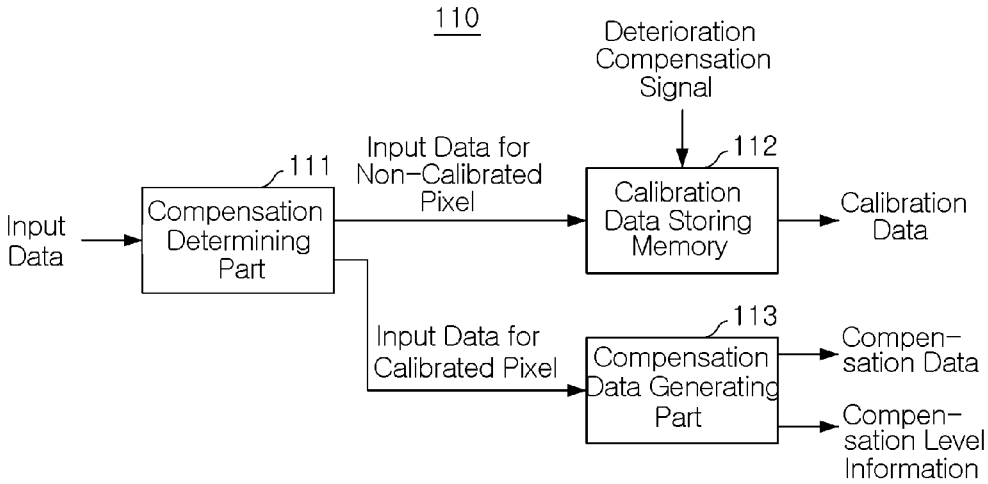
FIG. 2 is a schematic view illustrating the configuration of a converting unit employed in an organic light emitting diode driver according to an exemplary embodiment of the present invention.

FIG. 2 is a schematic view illustrating the configuration of a converting unit employed in an organic light emitting diode driver according to an exemplary embodiment of the present invention.

With reference to FIG. 2 together with FIG. 1, the converting unit 110 employed in the organic light emitting diode driver 100 may include a compensation determining part 111, a calibration data storing memory 112, and a compensation data generating part 113.

The compensation determining part 111 may determine whether the compensation of the input data has been performed, depending on whether calibration data corresponding to a target pixel to be driven by the input data is present or not.

When the input data is determined as input data for a non-calibrated pixel based on the results of determination of the compensation determining part 111, the calibration data storing memory 112 provides the driving unit 120 with calibration data, obtained in a deterioration compensation signal of the compensating unit 150. At this time, the calibration data storing memory 112 may have initial data, identical to the input data, stored therein at an operation start time. That is, since no deterioration may occur at the operation start time, the initial data, identical to the input data, may be stored in the calibration data storing memory 112.

On the other hand, when the input data is determined as input data for a calibrated pixel based on the results of determination of the compensation determining part 111, the compensation data generating part 113 provides the driving unit 120 with compensation data. At this time, when converting the input data into the compensation data, the compensation data generating part 113 may cause the pixel to be driven with data having an amount of bits different from that of the input data. For example, when the input data is 8-bit data of '01001100,' the compensation data may be used to add 2 bits thereto and convert the 8-bit data into 10-bit data. At this time, the 2 bits may be a most significant bit (MSB) and a least significant bit (LSB). Accordingly, the 10-bit compensation data may be converted into 'x01001100x.' The LSB may be adopted so as to increase the resolution of a target pixel which is to be compensated for its deterioration. The MSB may be adopted so as to prevent overflow which may occur when the amount of bits of the data is changed to be increased during the deterioration compensation.

Meanwhile, when converting the input data into the compensation data, the compensation data generating part 113 may generate the compensation data as a representative value of a predetermined gray scale range based on the gray scale level of the input data. In this manner, the compensation data generating part 113 may transmit compensation level information including the representative value to the compensating unit 150.

Figure 3:
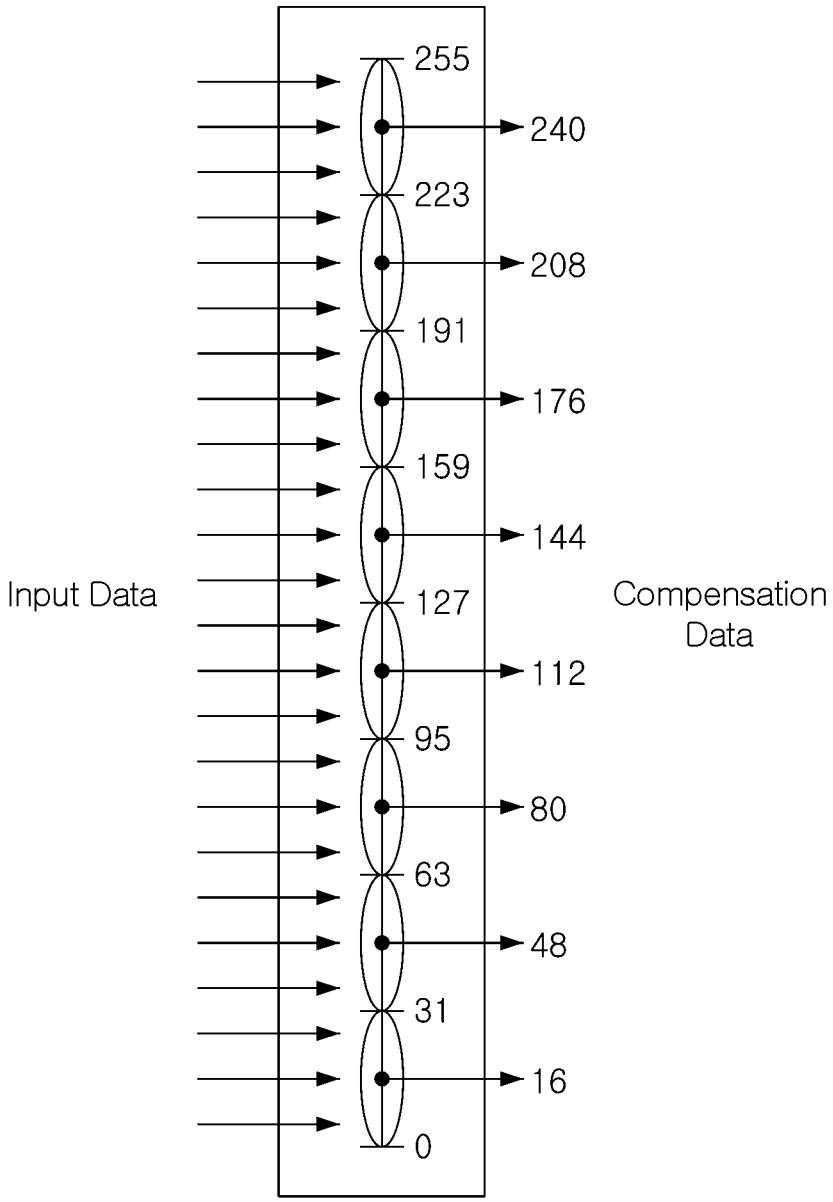
FIG. 3 is a view illustrating representative value ranges included in a compensation data generating part employed in the converting unit of FIG. 2.

FIG. 3 is a view illustrating representative value ranges included in a compensation data generating part employed in the converting unit of FIG. 2.

With reference to FIG. 3 together with FIGS. 1 and 2, the compensation data generating part 113 may have a gray scale range having predetermined levels. A plurality of gray scale ranges may be provided. When the gray scale level of the input data belongs to one of the plurality of gray scale ranges, the compensation data generating part 113 may generate the compensation data as a representative value of the corresponding gray scale range. For example, in the case in which the compensation data generating part 113 has eight gray scale ranges by dividing gray scale values ranging from 0 to 255 into eight parts, when input data has a gray scale value of 240, the compensation data generating part 113 generates compensation data as 240, which is a representative value in the $8^{th}$ gray scale range ranging from 223 to 255, and provides the compensation data to the driving unit 120. That is, the compensation data is generated as the representative gray scale value of the corresponding gray scale range, to which the gray scale level of the input data belongs, not as individual gray scale values of each individual piece of input data, whereby memory size may be reduced.

With reference to FIG. 1, the driving unit 120 may drive pixels of the pixel unit 130 based on the calibration data or the compensation data from the converting unit 110.

The pixel unit 130 may include a plurality of pixels having a matrix of a plurality of rows and a plurality of columns, and the pixels may be driven row by row.

The ADC 140 may convert an analog deterioration sensing signal, corresponding to a pixel from the pixel unit 130, into a digital deterioration sensing signal, and transmit the digital deterioration sensing signal to the compensating unit 150. The ADC 140 may convert deterioration information related to the degree of deterioration in the corresponding pixel of the pixel unit 130 into the digital deterioration sensing signal and transmit the digital deterioration sensing signal to the compensating unit 150.

The compensating unit 150 may provide a deterioration compensation signal based on the digital deterioration sensing signal.

Figure 4:
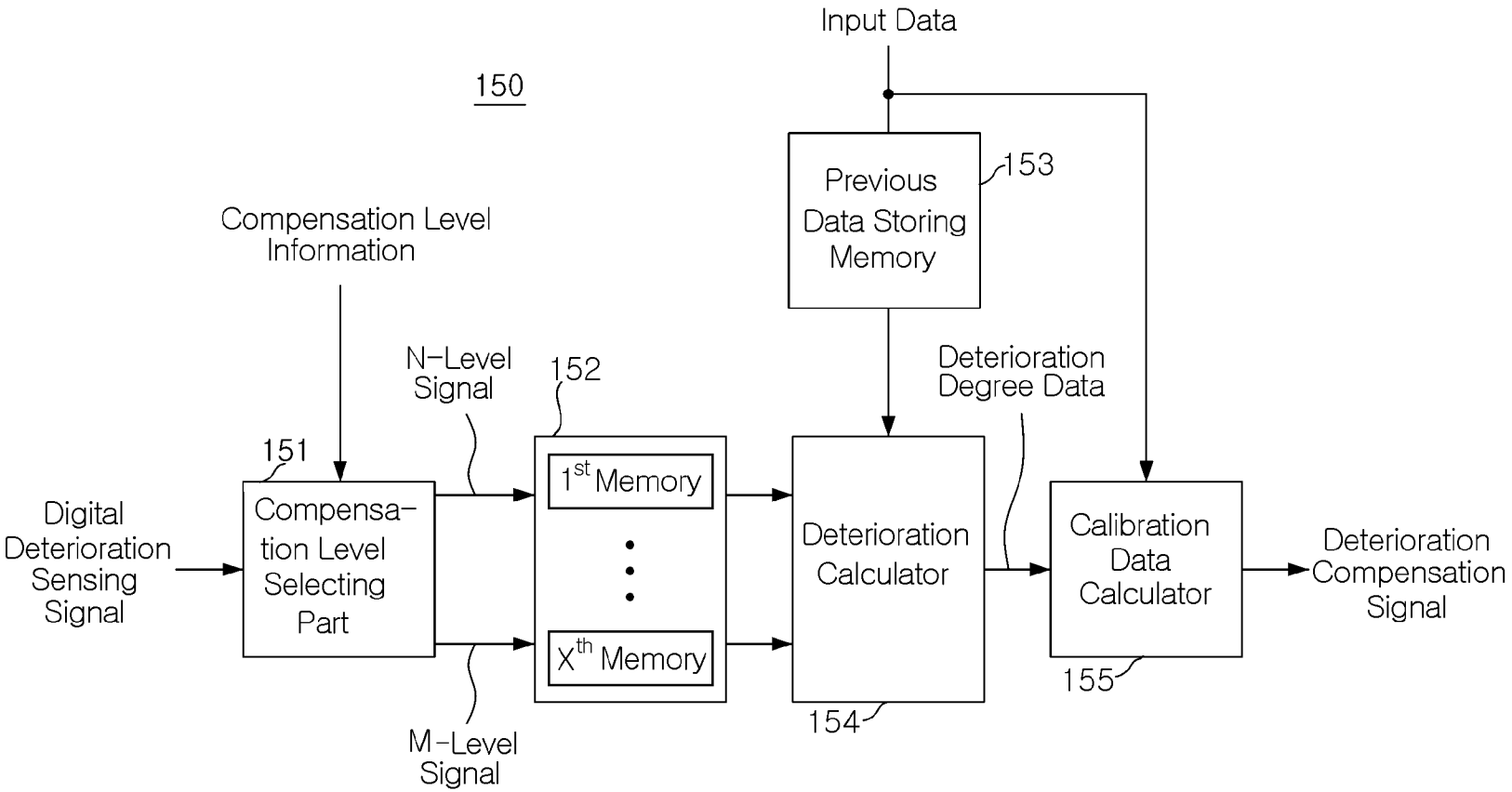
FIG. 4 is a schematic view illustrating the configuration of a compensating unit employed in an organic light emitting diode driver according to an exemplary embodiment of the present invention.

FIG. 4 is a schematic view illustrating the configuration of a compensating unit employed in an organic light emitting diode driver according to an exemplary embodiment of the present invention.

With reference to FIG. 4 together with FIG. 1, the compensating unit 150 employed in the organic light emitting diode driver 100 according to the exemplary embodiment of the invention may include a compensation level selecting part 151, a memory part 152, a previous data storing memory 153, a deterioration calculator 154, and a calibration data calculator 155.

The compensation level selecting part 151 may receive the digital deterioration sensing signal from the ADC 140 and the compensation level information from the converting unit 110, and select a memory based on a level signal corresponding to the level of the representative value included in the compensation level information.

The memory part 152 may include a plurality of memories. The number of memories may be the same as the number of the gray scale ranges. For example, in the case in which a representative value included in compensation level information from the converting unit 110 belongs to the $3^{rd}$ gray scale range among the eight gray scale ranges, the compensation level selecting part 151 transmits a $3^{rd}$ level signal, containing the digital deterioration sensing signal and the compensation level information corresponding thereto, to the $3^{rd}$ memory of the memory part 152 and causes the $3^{rd}$ level signal to be stored in the $3^{rd}$ memory. In the case in which a representative value included in compensation level information with respect to subsequent input data belongs to the $5^{th}$ gray scale range among the eight gray scale ranges, the compensation level selecting part 151 transmits a $5^{th}$ level signal, containing the digital deterioration sensing signal and the compensation level information corresponding thereto, to the $5^{th}$ memory of the memory part 152 and causes the $5^{th}$ level signal to be stored in the $5^{th}$ memory. In FIG. 4, "X" in the $X^{th}$ memory is a natural number greater than "1."

The previous data storing memory 153 may store initial luminance data of a target pixel to be compensated or luminance data obtained by the previous compensation.

The deterioration calculator 154 may calculate the degree of deterioration in the corresponding pixel by calculating a difference between one level signal, containing compensation level information and deterioration information of the corresponding pixel, and another level signal, containing compensation level information and deterioration information of the corresponding pixel, and comparing the result of the calculation with the luminance data from the previous data storing memory 153. For example, a difference between the $3^{rd}$ level signal, containing the compensation level information and the deterioration information corresponding thereto stored in the $3^{rd}$ memory, and the $5^{th}$ level signal, containing the compensation level information and the deterioration information corresponding thereto stored in the $5^{th}$ memory, is calculated to thereby remove an IR (current/resistance) drop across a transistor, serving to transmit power required for the driving of the pixel. Thereafter, deterioration information excluding IR drop components is compared with the luminance data from the previous data storing memory 153. In this manner, the degree of deterioration in the corresponding pixel is calculated to thereby output data indicative of the degree of deterioration (hereinafter, referred to as "deterioration degree data").

The calibration data calculator 155 may calculate calibration data adjusting the luminance of the corresponding pixel according to the degree of deterioration calculated by the deterioration calculator 154 and provide the converting unit 110 with a deterioration compensation signal including the calibration data. Here, the calibration data calculator 153 adjusts the luminance of the corresponding pixel to have a luminance equal to that of the entirety of pixels.

In order to more precisely compensate the pixel for the deterioration thereof, the calibration data may be more precisely set on the basis of the use time of the pixel. The converting unit 110 converts the input data into the calibration data based on the deterioration compensation signal so that the deterioration in the target pixel to be driven by the input data may be compensated for.

The operations of an organic light emitting diode driver according to the present invention will now be described in detail with reference to the accompanying drawings.

Figure 5:
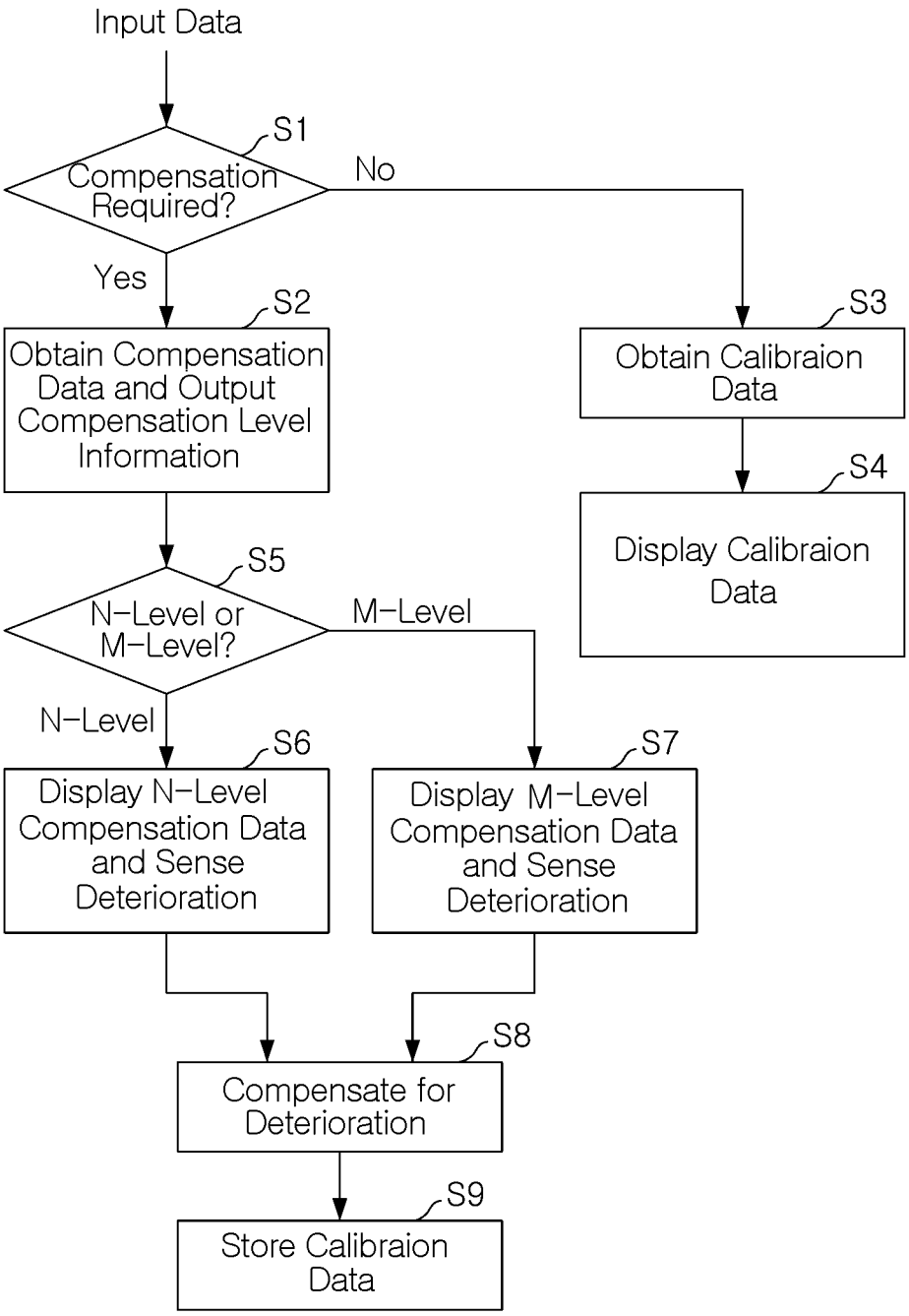
FIG. 5 is a flowchart illustrating the operations of an organic light emitting diode driver according to an exemplary embodiment of the present invention.

FIG. 5 is a flowchart illustrating the operations of an organic light emitting diode driver according to an exemplary embodiment of the present invention.

With reference to FIG. 5 together with FIGS. 1 through 4, in the organic light emitting diode driver 100 according to the present invention, when input data is inputted to drive a pixel, it is determined whether or not the input data has undergone deterioration compensation in operation S1. That is, when deterioration in the pixel driven by the input data has already been compensated for, the converting unit 110 may transmit calibration data corresponding to the input data to the driving unit 120 in operation S3. When deterioration in the pixel driven by the input data needs to be compensated for, the converting unit 110 may convert the input data into compensation data and transmit the compensation data to the driving unit 120 in operation S2. At this time, the compensation data generating part 113 may have a plurality of predetermined gray scale ranges and provide the driving unit 120 with the compensation data generated as a representative value of a gray scale range to which the gray scale level of the input data belongs. In addition, the compensation data generating part 113 may provide the compensating unit 150 with compensation level information having the representative value included in the compensation data in operation S2.

The driving unit 120 may drive the pixel of the pixel unit 130 based on the calibration data from the converting unit 110 in operation S4. Meanwhile, the compensation level selecting part 151 may cause the compensation level information from the converting unit 110 to be stored in the memory part 152 including a plurality of predetermined memories in a manner such that the compensation level selecting part 151 may select a memory based on the level of the compensation level information in operation S5. After the input data is converted into the compensation data, the compensation level selecting part 151 may select the corresponding memory of the memory part 152 based on the gray scale range of the representative value included in the compensation data. Herein, the number of the memories included in the memory part 152 corresponds to the number of gray scale ranges, and the compensation level information is stored in the corresponding memory in operations S6 and S7. At this time, a difference between a deterioration sensing signal with respect to N-level compensation data and a deterioration sensing signal with respect to M-level compensation data, which has a different level to that of the N-level compensation data, is calculated to thereby remove IR drop components across the transistor, serving as a switch transmitting power to the pixel. Thereafter, deterioration information excluding the IR drop components is compared with luminance data from the previous data storing memory 153, and thus deterioration degree data of the corresponding pixel is outputted in operation S8. Accordingly, calibration data is provided to the converting unit 110, and the converting unit 110 stores the calibration data in operation S9.

As described above, an organic light emitting diode driver according to exemplary embodiments of the invention can compensate for pixel deterioration in real time during the driving of pixels by selectively compensating pixels, requiring compensation, for the deterioration thereof, without the need for separate compensation time. In addition, since compensation data is set as a representative gray scale value within a gray scale range, compensation data corresponding to all the gray scale values is not required to be stored, whereby memory size can be reduced. Furthermore, calibration data can be precisely set by accomplishing the removal of an IR drop across a transistor, employed as a switch in the pixels, by calculating a difference between at least two representative values of different gray scale ranges among predetermined gray scale ranges.

As set forth above, an organic light emitting diode driver according to exemplary embodiments of the invention is capable of compensating for pixel deterioration in real time during the driving of pixels by selectively compensating pixels, requiring compensation, for the deterioration thereof, and precisely setting calibration data by removing an IR drop across a transistor, employed as a switch in the pixels, by calculating a difference between at least two representative values of different gray scale ranges among predetermined gray scale ranges.

While the present invention has been shown and described in connection with the exemplary embodiments, it will be apparent to those skilled in the art that modifications and variations can be made without departing from the spirit and scope of the invention as defined by the appended claims.

What is claimed is:

1. An organic light emitting diode driver comprising:

a converting unit having predetermined gray scale ranges and converting input data into compensation data set as a representative value of a gray scale range, to which a gray scale level of the input data belongs, in order to selectively compensate for pixel deterioration depending on whether the input data has been calibrated or not;

a driving unit driving pixels of a pixel unit based on the compensation data from the converting unit; and a compensating unit providing the converting unit with a deterioration compensation signal based on a difference between at least two level signals, each containing the representative value from the converting unit and deterioration information obtained from a pixel driven by the driving unit.

2. The organic light emitting diode driver of claim 1, wherein the converting unit stores calibration data included in the deterioration compensation signal from the compensating unit and converts input data for a target pixel to be non-calibrated into calibration data corresponding thereto.

3. The organic light emitting diode driver of claim 2, wherein the converting unit comprises:

a compensation determining part determining whether the input data has been compensated for or not, depending on whether calibration data corresponding to a target pixel to be driven by the input data is present or not;

a calibration data storing memory providing the calibration data corresponding to the input data based on a result of determination of the compensation determining part; and a compensation data generating part providing the compensation data and compensation level information corresponding to the input data based on a result of determination of the compensation determining part.

4. The organic light emitting diode driver of claim 3, wherein the compensation data generating part has a plurality of predetermined gray scale ranges, provides the compensation data as the representative value of the gray scale range, to which the gray scale level of the input data belongs, and transmits the compensation level information including the representative value to the compensating unit.

5. The organic light emitting diode driver of claim 4, wherein the compensating unit comprises:

a compensation level selecting part selecting a memory based on the compensation level information from the converting unit and the deterioration information of the driven pixel;

a memory part including a plurality of memories corresponding to the number of the gray scale ranges;

a previous data storing memory storing initial luminance data of the pixel to be compensated or luminance data obtained by a previous compensation;

a deterioration calculator calculating a degree of deterioration in the pixel by comparing a difference between one level signal, containing compensation level information and deterioration information corresponding thereto, and another level signal, containing compensation level information and deterioration information corresponding thereto, the level signals being stored in the memory part, with the luminance data from the previous data storing memory; and a calibration data calculator calculating calibration data adjusting a luminance of the pixel according to the degree of deterioration calculated by the deterioration calculator.

6. The organic light emitting diode driver of claim 5, wherein the calibration data calculator calculates the calibration data adjusting the luminance of the pixel to have a luminance equal to an average luminance of all of the pixels.

7. The organic light emitting diode driver of claim 4, further comprising an analog-to-digital converter (ADC) converting the deterioration information obtained from the driven pixel of the pixel unit into a digital deterioration sensing signal and transmitting the digital deterioration sensing signal to the compensating unit.

8. The organic light emitting diode driver of claim 7, wherein the compensating unit comprises:

a compensation level selecting part selecting a memory based on the compensation level information from the converting unit and the deterioration information of the driven pixel;

a memory part including a plurality of memories corresponding to the number of the gray scale ranges;

a previous data storing memory storing initial luminance data and use time of the pixel to be compensated or luminance data and use time thereof obtained by a previous compensation;

a deterioration calculator calculating a degree of deterioration in the pixel by comparing a difference between one level signal, containing compensation level information and deterioration information corresponding thereto, and another level signal, containing compensation level information and deterioration information corresponding thereto, the level signals being stored in the memory part, with the luminance data and the use time of the pixel from the previous data storing memory; and a calibration data calculator calculating calibration data adjusting a luminance of the pixel according to the degree of deterioration calculated by the deterioration calculator.

9. The organic light emitting diode driver of claim 8, wherein the calibration data calculator calculates the calibration data adjusting the luminance of the pixel to have a luminance equal to an average luminance of all of the pixels.

* * * * *

UNITED STATES PATENT AND TRADEMARK OFFICE

CERTIFICATE OF CORRECTION

PATENT NO. : 8,471,788 B2
APPLICATION NO. : 13/036363
DATED : June 25, 2013
INVENTOR(S) : Sang Hyun Cha et al.

It is certified that error appears in the above-identified patent and that said Letters Patent is hereby corrected as shown below:

On the title page, Item "(73) Assignee", please change

"Samsung Electronics Co., Ltd., Suwon, Gyunggi-do (KR)" to

--Samsung Electro-Mechanics Co., Ltd. Suwon, Gyunggi-do (KR) and

Korea Advanced Institute of Science and Technology, Daejeon (KR)--.

Signed and Sealed this
Sixteenth Day of July, 2013

Teresa Stanek Rea
*Acting Director of the United States Patent and Trademark Office*